United States Patent [19]

Kranenberg et al.

[11] 3,981,752

[45] Sept. 21, 1976

[54] METHOD FOR CONTROLLING THE TEMPERATURE OF STEEL DURING HOT-ROLLING ON A CONTINUOUS HOT-ROLLING MILL

[75] Inventors: Helmut Kranenberg, Orchard Park, N.Y.; Richard S. Hostetter, Jr., Bethlehem, Pa.

[73] Assignee: Bethlehem Steel Corporation, Bethlehem, Pa.

[22] Filed: Dec. 10, 1974

[21] Appl. No.: 531,272

Related U.S. Application Data

[63] Continuation of Ser. No. 416,309, Nov. 15, 1973, abandoned.

[52] U.S. Cl. ..... 148/12 B; 148/36

[51] Int. Cl.[2] ..... C21D 7/14

[58] Field of Search ..... 148/12 B, 12.4, 156, 148/36

[56] References Cited

UNITED STATES PATENTS

| | | | |
|---|---|---|---|
| 1,931,912 | 10/1933 | Whitzel | 72/201 |
| 2,067,514 | 1/1937 | Trinks | 72/45 |
| 2,516,248 | 7/1950 | O'Brien | 148/155 |
| 2,673,820 | 3/1954 | Morgan | 148/12 B |
| 2,747,587 | 5/1956 | Strachan | 134/57 R |
| 2,756,169 | 7/1956 | Corson | 148/156 |
| 2,880,739 | 4/1959 | Popp | 134/46 |
| 3,011,928 | 12/1961 | Kopec et al. | 148/156 |
| 3,389,021 | 6/1968 | Easter et al. | 148/12 B |
| 3,604,691 | 9/1971 | Sherwood | 148/153 |
| 3,645,805 | 2/1972 | Hoffmann et al. | 148/156 |
| 3,735,966 | 5/1973 | Hoffmann et al. | 148/156 |
| 3,766,763 | 10/1973 | Cofer et al. | 72/13 |

OTHER PUBLICATIONS

Minarik, J.; "The Course of the Rolling Stock Temperature in Continuous Section Rolling Mills;" Hutnick, 1972, (6), 213–217.

Almond, F. M.; "Heat Treatments;" Inst. of Iron and Steel Wire Manuf.; Paper No. 3; Mar. 1972.

Kemshall, G. E.; "Light Bar and Section Mill Technology–3 Continental Mill Practices;" Steel Times, Mar. 1973; pp. 261–265.

*Primary Examiner*—W. Stallard

*Attorney, Agent, or Firm*—Joseph J. O'Keefe; Charles A. Wilkinson; John S. Simitz

[57] ABSTRACT

Method for hot-rolling carbon and alloy steels in a continuous hot-rolling mill including spraying water onto the surface of the steels at selected locations in the continuous hot-rolling mill during hot-rolling of the steels in order to control the temperature of the steels. The hot-rolled steels off-the-mill have an integrated mean temperature of not more than about 1750° F. and can have a surface temperature of about 1700° F. The as-rolled steel products produced by the method have uniform metallurgical characteristics. The scale which forms on the surface of the steels during air-cooling to ambient temperature is uniform, smooth, fine-textured and relatively thin.

11 Claims, 15 Drawing Figures

METHOD FOR CONTROLLING THE TEMPERATURE OF STEEL DURING HOT-ROLLING ON A CONTINUOUS HOT-ROLLING MILL

This is a continuation of application Ser. No. 414,309, filed Nov. 15, 1973, now abandoned.

BACKGROUND OF THE INVENTION

This invention relates to hot-rolling of steel and more particularly to a method for hot-rolling carbon and alloy steels in a continuous hot-rolling mill wherein water or other coolant is sprayed onto the surface of the steels between passes during hot-rolling to control the temperature of the steels during rolling and to produce steel products which have uniform metallurgical characteristics. The scale which forms on the surface of the steels during air-cooling to ambient temperature is uniform, smooth, fine-textured and relatively thin.

The conventional method for producing steel products, such as straight or coiled bars, coiled rods, wire and the like, involves hot-rolling carbon and alloy steels starting with at least billet sized metal blanks heated to an elevated temperature within a range of about 1950° F. – 2150° F. and continuously rolling the blanks in a continuous hot-rolling mill, such as a billet mill, bar mill, rod mill and the like. Usually the hot-rolled products off-the-mill have a surface temperature within the range of about 1850° F. to about 2100° F. Steel products hot-rolled by the conventional method on a continuous hot-rolling mill do not have uniform metallurgical characteristics and a non-uniform, thick, coarse and sometimes blistery scale forms on the surface of the steels during air-cooling to ambient temperature. The scale is difficult to remove by pickling in acid pickling solutions, for example, aqueous solutions of hydrochloric acid and the like, and the steels can be "burned" by the pickling solutions in areas where the blistery scale occurs.

It has, therefore, been a continuing aim of industry to produce steel products which have more uniform metallurgical characteristics than can be attained with conventional rolling practice and which have as little scale as possible formed on the surface of the air-cooled finished product. To achieve this aim, several methods of treating the steels after hot-rolling have been proposed and tried. One method that has been suggested and tried to avoid the development of objectionable scale has been to cool the as-rolled steel in an inert atmosphere immediately off-the-mill. This method was complex and was not particularly successful. Methods for treating the steel after hot-rolling are exemplified in U.S. Pat. No. 2,673,820 issued Mar. 30, 1954 to M. Morgan entitled "Treatment of Hot Metal Rods" and U.S. Pat. No. 2,516,248 issued July 25, 1950 to J. E. O'Brien entitled "Method and Apparatus for Cooling Rods" which are concerned with continuously hot-rolling steel billets to coil form and treating the coiled material to control the microstructure of the material and the scale formed on the surface during cooling. Morgan is directed to providing an air blast to cool the steel as it is being coiled on a reel, while O'Brien is directed to cooling the steel coil after removal from the reel. In either case, the cooling of the steel product is too late to effectively overcome the above mentioned problems, that is, control either the microstructure or the formation of scale on the surface. Other prior methods include U.S. Pat. No. 2,756,169 issued July 24, 1956 to J. H. Corson et al entitled "Method for Heat Treating Hot Rolled Steel Rods" which is directed to cooling hot-rolled steel rods rapidly to a temperature range of 900° F. – 1300° F. after being rolled to finish size. The steel rods are held within the above mentioned temperature range for a time to allow carbon to come out of the solution. After cooling, the rods are coiled. The cooling method includes sequentially quenching the rods in water and air after the rods come off the last roll stand of the finishing train to obtain the desired temperature. U.S. Pat. No. 3,001,928 issued Dec. 5, 1961 to J. B. Kopec et al entitled "Method for Heat Treating Hot Rolled Steel Rods" is directed to quenching steel rods in a water cooling chamber after the rods have been finish rolled and come off the last roll stand of the finishing train. The rods are coiled on a reel and are subjected to a second cooling step during coiling. U.S. Pat. No. 3,645,805 issued Feb. 29, 1972 to Hoffman et al is directed to depositing as-rolled steel rods or wire in overlapping turns or waps on a conveyor, maintaining the temperature of the steel to obtain a uniform grain size of not more than 5 and thereafter controlling the cooling of the steel to produce a microstructure of ferrite and pearlite. U.S. Pat. No. 3,389,021 issued June 18, 1968 to C. G. Easter et al and entitled "Process for Preparing Steel for Cold Working" is directed to water quenching the steel rods as they come off the last roll stand of a finishing mill. The steel rods are cooled to a temperature of 1450° F. and the coils are laid in an overlapping configuration on a conveyor and are air quenched to 700° F. The rods are then coiled. U.S. Pat. No. 2,747,587 issued May 29, 1956 to A. W. Strachan entitled "Apparatus for Quenching and Reeling Rods" and U.S. Pat. No. 2,880,739 issued Apr. 7, 1959 to J. A. Popp entitled "Apparatus for Quenching and Reeling Rods" are directed to treating steel rods after finish rolling. The steel rods are passed through a series of delivery tubes in which the rods are quenched in water after finish rolling in the last roll stand of a continuous hot-rolling mill, but prior to coiling on a reel. U.S. Pat. No. 3,604,691 issued Sept. 14, 1971 to William George Sherwood entitled "Apparatus and Method for Coiling and Quenching Rod" is directed to coiling steel rod as it comes off-the-mill on a reel and water quenching the coiled rod continuously while the rod is being coiled. The water quenching is accomplished by lowering the reel and the rod coiled thereon into a tank containing water. U.S. Pat. No. 3,735,966 issued May 29, 1973 to Bernd Hoffman and entitled "Method for Heat Treating Steel Wire Rod" is directed to alternately quenching and air cooling steel rod off-the-mill and prior to coiling. The alternate quenching and cooling prevents the formation of martensite in the steel.

While the above prior art practices have achieved some measure of success, the uniformity of metallurgical properties has not been fully achieved and the problem of scale formation has not been satisfactorily solved. The prior equipment and temperature control systems required to perform the treatment steps are frequently delicate, complex and expensive and generally cannot be installed on existing mills because of space problems. Attempts to control the temperature of the hot-rolled steel prior to air-cooling have included initially heating the steel to lower than normal rolling temperatures and also decreasing the rate of hot-rolling. While some beneficial effects have resulted, it has not been found practical or economically feasible to hot-roll steels in these prior suggested manners. Prior art attempts to control the finishing temperature of the steels in methods in which the steels are initially heated to relatively low temperatures of about 1500° F. to 1800° F. for hot-rolling have met with little success because the electric motors which drive the roll stands in the roughing and intermediate train became dangerously overloaded due to the strain of rolling "cold" steels. Overloading can usually be avoided by operating the line at low speeds but production is then lost and such an expedient is therefore not economically feasible.

During hot-rolling, the steel achieves high speed, for example, finishing speeds as high as 4,000 feet per minute in a bar mill and 10,000 feet per minute in a rod mill. The high speed at which the steel is hot-rolled is one of the reasons it has been deemed impractical, if not impossible, to treat the steel during hot-rolling. Therefore, prior art methods of achieving the above goals have been generally directed to treating the as-rolled steels off-the-mill.

Duplex grain structure in the as-rolled coiled steel occurs near the surface of the steel, because the steel retains heat, for a sufficient length of time to allow some grains to become enlarged at the expense of other grains. The overlapping loops of steel come in contactt with each other and areas in which heat is retained for long periods of time are formed, thereby causing grain growth and duplex grain formation in these areas.

The overall grain structure of the rolled steels also tends to be excessively coarse due to high finishing temperatures. Excessively coarse grain, like duplex grain, is difficult to spherodize anneal or cold form. The distribution of the spheroids formed during annealing also tends to be non-uniform. Acicular bainite forms in alloy steels during air-cooling after hot rolling at normal temperatures. Acicular bainite makes the alloy steels hard and brittle and difficult to cold work.

Heavy scale also forms on the as-rolled steel during air-cooling to ambient temperature. The formation of heavy, uneven, rough texture scale to due to the time required for the steels to cool from high finishing temperatures to ambient temperature. Coiled steel retain heat longer than steels which are exposed on all surfaces to a cooling medium. Hence in coil form, scale formation is accentuated. Of course, high finishing temperatures of straight bars also result in the formation of a heavy scale on the steel.

The above cited prior art while partially successful has not completely solved the problems of coarse grain structure, duplex grain formation, acicular bainitic formation and scale formation on as-rolled bars and rods.

It has been generally recognized that coarse grain structure, duplex grain structure and scale formation are due to the elevated finishing temperatures of the rolled steel. As explained above, prior art attempts to alleviate the problems of the prior art have been directed to cooling the steel off-the-mill or alternatively to the use of lower than normal initial hot-rolling temperatures in order to finish roll the steel at lower than normal finishing temperatures. Treatment of the steel after finish rolling has not been completely successful. Heating to lower-than-normal rolling temperatures is also impractical since the mill motors either overload, resulting in burned-out motors, or the steel must be rolled at a very slow speed, which is impractical.

We have discovered that the elevated finishing temperatures off-the-mill are caused by excessive heat generated in the steel being hot rolled during its passage through the intermediate and finishing train. Coarse grain structure is thus initiated before the metal leaves the mill.

We have discovered, furthermore, that it is possible to roll steel at normal roughing temperatures at the same or increased rates of speed to produce a product off-the-mill which is free of duplex and coarse grain structure and which has a thin, uniform scale formed thereon.

SUMMARY OF THE INVENTION

The foregoing difficulties and problems due to duplex and coarse grain structure and heavy scale associated with modern high speed rolling processes, for example, in bar mills and rod mills, have now been obviated by operation in accordance with the present invention. We have discovered that if the steel being hot-rolled is cooled at selected locations between rolling passes by being forcibly sprayed with liquid coolant streams so that the integrated mean temperature, i.e., the maximum temperature to which the steel can be reheated by residual heat after cooling of the surface, is not greater than 1750° F. and the surface temperature is preferably not greater than about 1700° F. that duplex and coarse grain structures and objectionable heavy scale can be avoided. The liquid coolant streams, which are preferably comprised principally or solely of water, since water has a very high specific heat or heat extractive capacity, are directed at the steel and the expended water is removed from the steel surface in a manner and in such quantity that the formation of a coolant bath is avoided and the coolant is not heated to an extent such that is vaporizes. By controlling the temperature of the steel by spray cooling during rolling particularly in between the roll passes in later stages of rolling i.e., subsequent to roughing or rough rolling and during intermediate and/or finish rolling where the maximum build-up of heat normally occurs, the temperature of the steel is kept below the point at which significant isolated grain growth and the formation of a detrimental heavy scale during cooling after rolling is prevented.

It is therefore the primary object of this invention to provide a method for treating hot rolled carbon and alloy steel while rolling, which method is simple, requires relatively inexpensive equipment which can be installed on existing mills and which will alleviate the above-mentioned problems.

It is another object of this invention to provide a method for hot-rolling carbon and alloy steels whereby the integrated mean temperature of the as-rolled product is not more than about 1750° F.

It is another object of this invention to provide a method for hot-rolling carbon and alloy steels wherein the surface of the hot-rolled steels is sprayed with water in the form of high pressure jets, during passage through a continuous hot-rolling mill and prior to being rolled to finish size on the continuous hot-rolling mill.

It is a further object of this invention to provide a method for producing as-rolled air-cooled carbon and alloy steel products on a continuous hot-rolling mill, which products are characterized by having a uniform, smooth, fine-textured, relatively thin scale formed on the surface thereof during air-cooling after hot-rolling, which scale is easily removed by pickling in acid pickling solutions.

It is a still further object of this invention to produce as-rolled air-cooled carbon and alloy steel products by hot-rolling on a continuous hot-rolling mill, said steel products having uniform metallurgical characteristics.

It is an additional object of this invention to provide as-rolled air-cooled carbon and alloy steel products which are characterized by having a substantially uniform microstructure of pearlite in a ferritic matrix, uniform elongation of grains in the rolling direction, uniform grain size, improved ductility and toughness.

Broadly, the method of the invention includes hot-rolling carbon and alloy steel on a continuous hot-rolling mill and cooling the steel by spraying water onto the surface of the steel between selected roll stands during its passage through the continuous hot-rolling mill and prior to hot-rolling the steel to finish size.

DESCRIPTION OF THE PREFERRED EMBODIMENT

Carbon and alloy steels, hereinafter referred to as steel, are in accordance with the present invention hot-rolled on a continuous hot-rolling mill, such as a bar mill, rod mill and the like, to produce as-rolled steel bars and rods which have uniform metallurgical characteristics, are substantially free from duplex grain structures and coarse grain structures, and have a substantially uniform fine-grained structure of pearlite in a fine-grained ferrite matrix. The scale formed on the surface of the steel rods and bars during air-cooling to ambient temperature is uniform, smooth, fine-textured and relatively thin. During hot-rolling the surface of the steel is sprayed with water at selected locations between roll stands in the hot-rolling mill to control the temperature of the steel.

Figure 1:
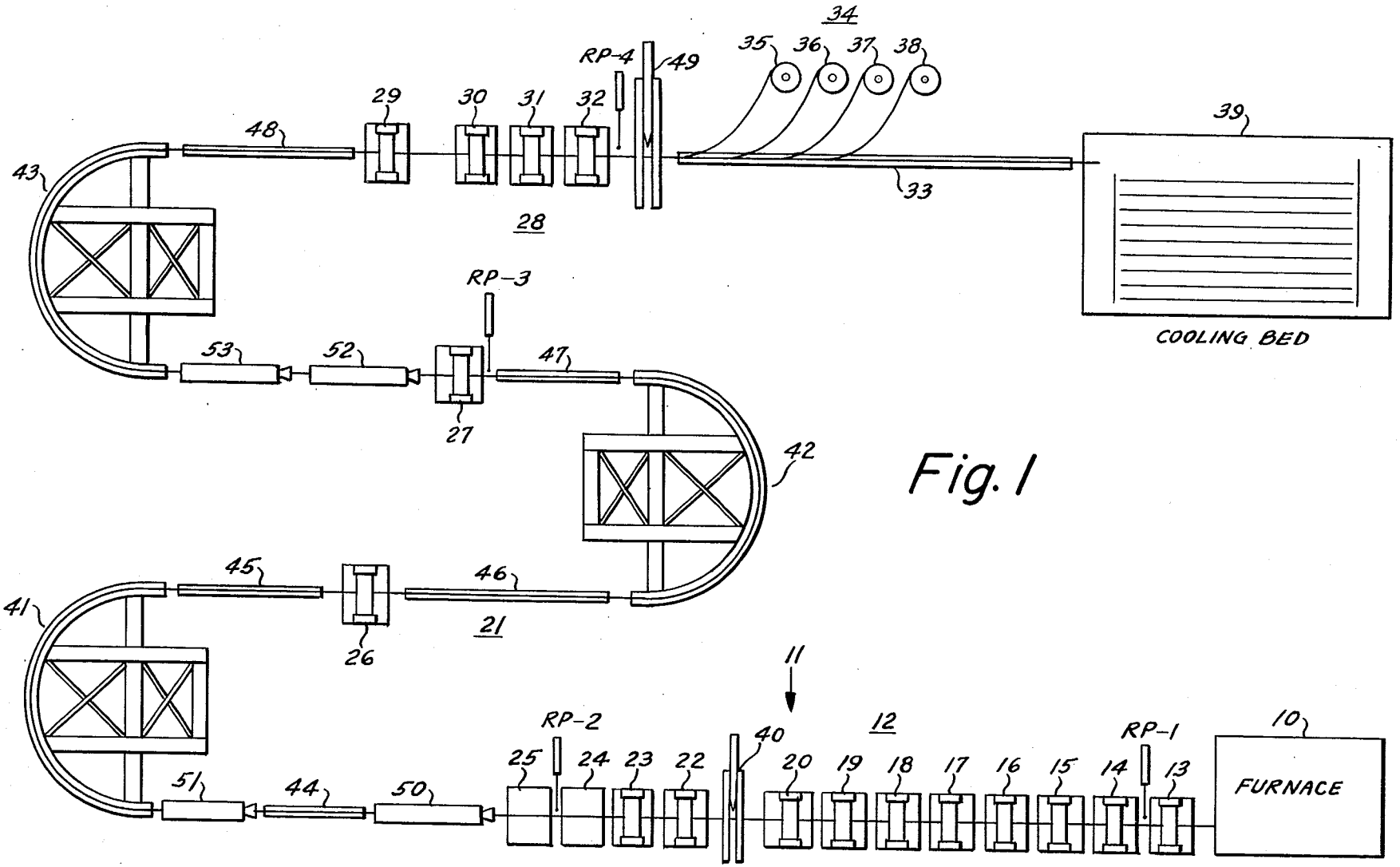
FIG. 1 is a schematic representation of a continuous hot-rolling mill used in the method of the invention.

Turning now to FIG. 1, which is a schematic drawing illustrative of a continuous hot-rolling mill (hereinafter referred to as the mill) and auxiliary equipment used in the method, steel is heated to a rolling temperature within the range of about 1950° F. to about 2150° F. in a furnace 10 generally used for this purpose. The steel is discharged from furnace 10 and is hot-rolled to finish size in mill 11 which comprises a roughing train 12 having roll stands 13, 14, 15, 16, 17, 18, 19 and 20; an intermediate train 21 having roll stands 22, 23, 24, 25, 26 and 27; finishing train 28 having roll stands 29, 30, 31 and 32; a run-out table 33; a coiling station 34 having coilers 35, 36, 37 and 38 and a cooling bed 39. A flying shear 40 is provided between the roughing train 12 and intermediate train 21. Repeaters 41 and 42 in the intermediate train 21 and repeater 43 between the intermediate train 21 and finishing train 28, are provided to loop the steel 180° during hot-rolling. Troughs 44, 45, 46 and 47 in the intermediate train 21 and trough 48 between repeater 43 and the finishing train 28, provide support for the steel as it passes through the mill 11. A flying shear 49 in the finishing train 28 removes the ends of the steel prior to finish rolling and also cuts the steel to length when required. Spray units 50 and 51 in the intermediate train 21 and spray units 52 and 53 between the intermediate train 21 and finishing train 28 are used to spray water onto the surface of the steel as it is being hot-rolled to control the temperature of the steel.

In operation, the steel is passed from the furnace 10 to the mill 11 and passes progressively continuously through the roll stands 13, 14, 15, 16, 17, 18, 19 and 20 in the roughing train 12. The temperature of the steel is observed by use of radiation-type pyrometer RP-1 between roll stands 13 and 14. A short portion of the front end of the steel is cropped by flying shear 40 as the steel passes between roll stand 20 and the first roll stand 22 of the intermediate train 21. The steel continues through the roll stands 22, 23, 24, 25, 26 and 27 of the intermediate train 21. Roll stands 24 and 25 appear as dummy stands in FIG. 1, that is, there are no rolls in the roll stands and hence the steel is not reduced in cross-sectional area as it passes through these stands. However, dependent upon the size of steel being hot-rolled and the desired finish size, the stands can be equipped with matched rolls to also reduce the cross-sectional area of the steel during its passage through these stands. The temperature of the steel is taken by a radiation-type pyrometer, RP-2, as it passes between roll stands 24 and 25. As the steel passes through the intermediate train 21, it is looped 180° by repeaters 41 and 42. Of course, steel can be hot-rolled in an in-line continuous hot-rolling mill which does not require the use of repeaters. As the steel passes through the intermediate train 21, the steel passes through spray units 50 and 51 located between roll stands 25 and 26. Water is sprayed onto the surface of the steel as it passes through the spray units 50 and 51. The flow of water in each spray unit in the mill is controlled to start after the leading end of the steel has passed through the spray unit to prevent hardening of the leading end of the steel and thereby prevent marring or spalling of the surface of the work rolls in the roll stands which could occur as the steel enters the roll passes in the roll stands. The steel is supported by trough 44 as it passes between first spray unit 50 and second spray unit 51. The steel is looped 180° in repeater 41 and is supported by trough 45 as it passes to roll stand 26. Trough 46 supports the steel as it passes to repeater 42 where the steel is again looped 180° and is passed to roll stand 27 which is the last roll stand in the intermediate train 21. The temperature of the steel is again taken by a third radiation-type pyrometer, RP-3, prior to rolling in roll stand 27. After the steel passes from the intermediate train 21 it passes through spray units 52 and 53 arranged in tandem. The steel is again looped 180° in repeater 43, passes through trough 48 and is rolled to a desired finish size in roll stands 29, 30, 31 and 32 of the finishing train 28. A flying shear 49 after roll stand 32 cuts the steel to the desired length. The temperature of the steel is again taken by a radiation-type pyrometer, RP-4, as it leaves the last roll stand 32 in the finishing train 28. If it is desired to coil the steel, it is passed to one of coilers 35, 36, 37, 38 in coiling station 34. If straight bars are being produced, the steel is passed to the run-out table 33 and then to cooling bed 39. In either case, the steel is air-cooled to ambient temperature after finish rolling.

We have found that by hot-rolling the steel as described above, the temperature of the surface of the steel off-the-mill may be as high as 1740° F., for example, in bars and rods which have a finished diameter of one-half of an inch, and the integrated mean temperature of the steel off-the-mill is not higher than about 1750° F. Steel hot-rolled in the conventional manner, that is, steel not water sprayed during rolling, has a surface temperature of between about 1900° F. and 2100° F. and an integrated mean temperature of between about 1900° F. and 2100° F.

Duplex grain structures and undesirably coarse grain structures in the rolled steel occurs due either to exposure of the rolled steel to excessively elevated temperature or to elevated temperatures for excessive periods. The thought in most prior attempts to solve the problems associated with excessive temperatures has been to reduce the temperature of the rolled steel quickly to a harmless level subsequent to completion of rolling. Accelerated cooling of the rolled steel has also been expected to eliminate the objectionable heavy scale which tends to develop upon the surface of the rolled steel during and particularly immediately subsequent to rolling. As explained above, these prior attempts to solve the problem have not been outstandingly successful.

We have found through extensive experimental work that the heat problem which causes grain growth and duplex grain structure, i.e., a structure in which large grains are associated with small grains, results not only from a relatively high initial rolling temperature, which is needed as explained above to prevent damage to the rolling mill and so as not to require the use of excessive power in rolling, but on the contrary results even more directly from a buildup of heat in the rolled piece due to the rolling process itself. This buildup of heat due to the working of the piece during rolling prevents the elevated temperature of the piece from decreasing and usually causes an increase in the temperature of the piece as rolling proceeds. In fact, we have found that the lower the initial rolling temperature and the greater the decline in temperature during the initial portions of the rolling operation, i.e., during rough and the first portion of intermediate rolling, the greater the increase in temperature during the final rolling steps. This effect is due to the energy expended in reducing the stiffer steel and surprisingly tends to result in high temperatures during the later stages of rolling even with lower initial or starting temperatures. We believe this buildup of heat is more detrimental than the initial heat of the steel since as rolling proceeds and the heat content of the steel progressively builds up there are also progressively fewer subsequent roll passes and reduction in cross-sectional area in each pass to break down any enlarged grains in the steel. The finishing passes in fact may serve to initiate and accelerate excessive and uneven grain growth after the metal leaves the roll pass. Since the most detrimental grain growth occurs due to heat input to the steel during rolling, it is possible to avoid the difficulty by rolling at a reduced speed or rate. In this manner the steel is allowed to cool sufficiently between passes to more than offset the heat induced by rolling. Reducing the rolling speed or rate also, of course, reduces the production rate and thus is not a satisfactory solution to the problems, except in special circumstances where it is absolutely essential for certain products to alleviate coarse and duplex grain. Experiments have been conducted in which, in order to decrease the temperature of the steel during high speed rolling, the steel is passed through water baths positioned between some roll passes. These experiments have not, however, substantially alleviated the coarse and duplex grain or scale problem, apparently, it is believed, because of the formation of a vapor blanket about the metal piece which blanket reduces the cooling rate of the metal. As noted supra it has generally been considered in any event that due to the extremely high speeds of modern rolling processes, that it would be completely impractical to effectively cool a steel section between hot rolling passes.

Cooling the steel subsequent to its passage through the entire rolling, because of the excessive buildup of heat during the later stages of rolling, can alleviate, but cannot cure the coarse grain problem on high speed mills because the grain structure has already coarsened before the steel leaves the mill. Duplex grain structure, which appears to occur principally after the steel leaves the mill and is coiled, on the other hand, could possibly be cured by drastic cooling after leaving the mill, but the surface layers of the steel would then be excessively cooled.

Unexpectedly, the microstructure of alloy bars and rods, for example, AISI 8615 grade steel bars and rods, rolled and spray cooled in accordance with our invention was found to consist of fine pearlite uniformly distributed in a fine-grained ferritic matrix with no evidence of coarse acicular bainite which is usually associated with such alloy steels when rolled in accordance with conventional hot-rolling methods.

Figure 2:
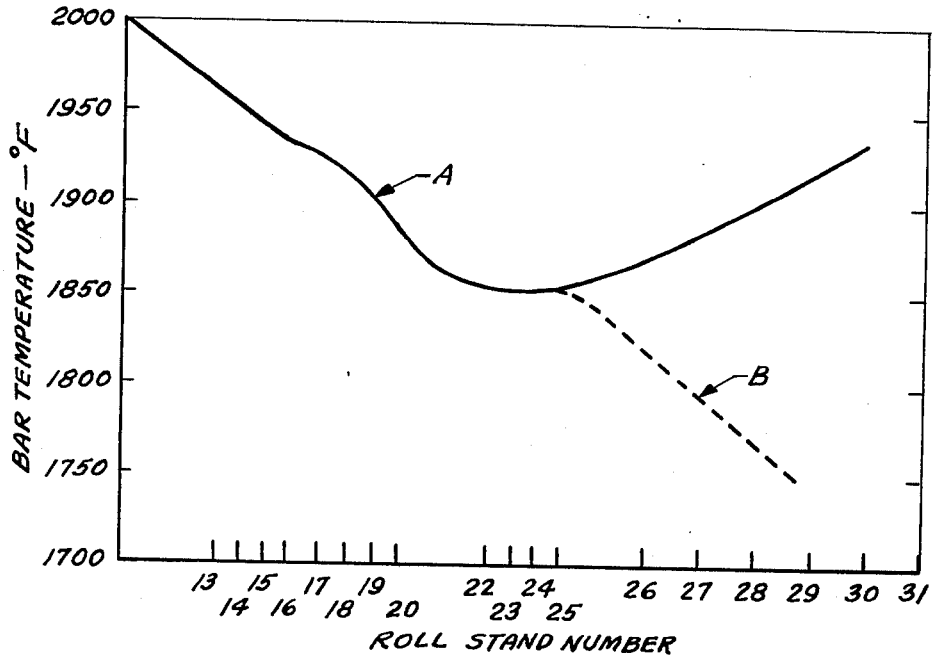
FIG. 2 is a graphic comparison of the temperature developed on the surface of carbon and alloy steels which are hot-rolled by the method of the invention and by conventional hot-rolling method.

FIG. 2 is a graph comparing the surface temperature profiles of steel hot-rolled by a conventional hot-rolling mill practice, identified as curve A, and as hot-rolled by the above described method, identified as curve B. In both cases, the steel is heated to a rolling temperature within the range of about 1950° F. to about 2150° F. The temperature of the steel decreases as it is rolled in the roughing train and the first portion of the intermediate train. As noted by curve A, the temperature begins to increase during hot-rolling in the intermediate train and continues to increase during rolling in the finishing train. The temperature of the steel off-the-mill can be as high as original rolling temperature. However, as shown by curve B, the temperature of the steel, hot-rolled by our method, does not increase but decreases in accordance with the amount of spray cooling. The steel off-the-mill has an integrated mean temperature of not more than about 1750° F. and a surface temperature as high as 1740° F. in bars and rods which have a diameter of one-half of an inch, but preferably not more than 1700° F. in bars and rods which have a diameter greater than one-half of an inch.

We have found that the integrated mean temperature of hot-rolled steel as it comes off-the-mill is related to the quantity of water sprayed onto the surface of the steel, the gage pressure of the water which is sprayed onto the surface of the steel and the rate of hot-rolling steel according to the following equation:

$$T_m = f\,\frac{q\sqrt{p}}{W}$$

where $T_m$ is the integrated mean temperature of the steel in ° F., $q$ is the quantity of water sprayed onto the surface of the steel in gallons per minute, $p$ is the gage pressure of the water in pounds per square inch as it is fed to high pressure jets, and W is the rate of rolling steel in tons per hour.

$$T_m = \frac{2}{R^2}\int_0^R r\,T(r)\,dr$$

wherein

Tm — is the integrated mean temperature,

R — is the radius of the as-rolled product as it comes off-the-mill,

T(r) — is the temperature distribution in crosssection at a point in time, and $r$ — is the radial space coordinate.

When we refer to steel "off-the-mill", we mean steel as it issues from between the rolls in the last roll stand of the finishing train in the continuous hot-rolling mill. By "as-rolled" steel, we mean steel that has not been heat-treated after rolling, for example, annealing, normalizing, and the like. Steel which is coiled or passed to a cooling bed after rolling and is air-cooled to ambient temperature is said to be in the as-rolled air-cooled condition. Therefore, an as-rolled air-cooled product off-the-mill is a steel product which has issued from the last roll stand in the finishing train in the continuous hot-rolling mill and which has not been subjected to any subsequent treatment other than being coiled and cooled in still air.

The time that the steel is exposed to high pressure water jets is a factor in controlling the surface temperature of the steel off-the-mill. Because the steel is hot-rolled at high speeds, for example, speeds off-the-mill of about 2500 feet per minute to about 4500 feet per minute in bars mills to as high as 10,000 feet per minute in rod mills, the time the surface of the steel is exposed to the high pressure water jets is minimized. It is therefore necessary to supply a large quantity of water at a relatively high pressure to the surface of the steel during a minimum amount of time. The quantity of water used and the gage pressure of the water are interrelated.

Figure 3:
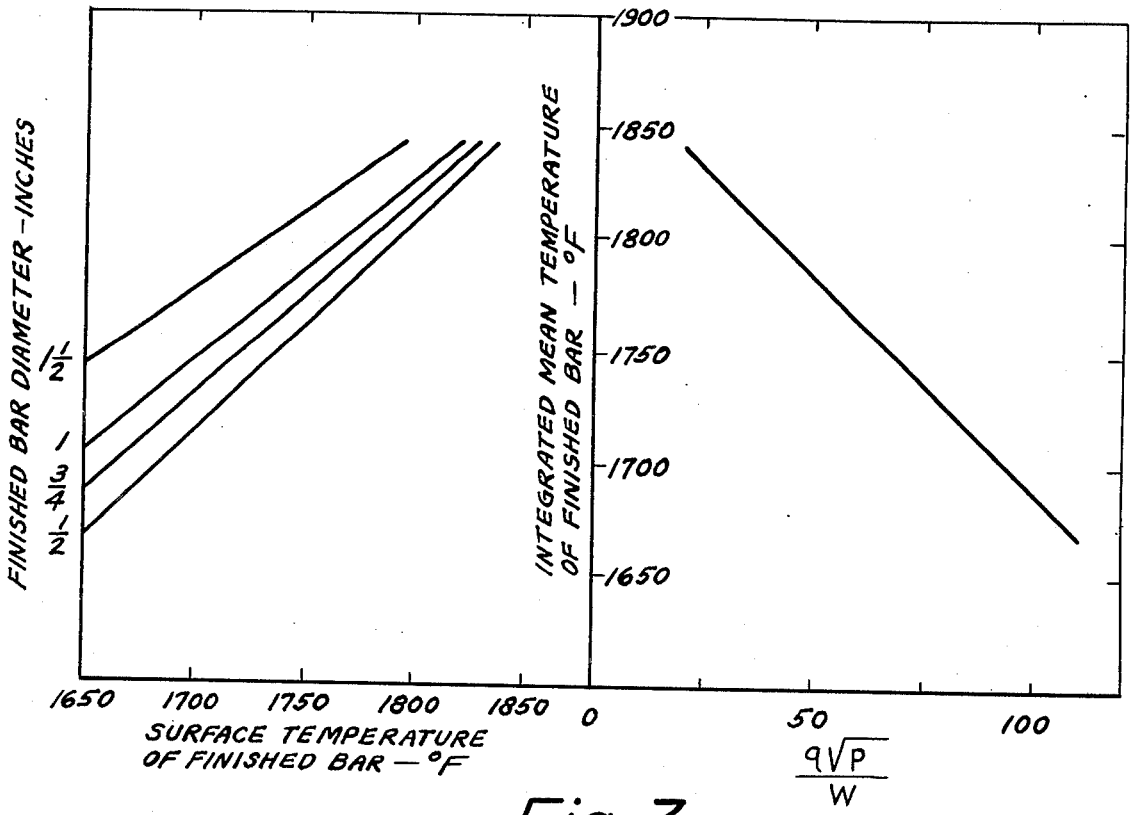
FIG. 3 is a nomograph showing the relationship between the integrated mean temperature and surface temperature of steel, off-the-mill, and between the integrated mean temperature of the steel and the amount of water and the pressure of the water sprayed onto the surface of the steel and the rate of rolling steel.

When water comes into contact with steels at elevated temperatures a steam blanket forms around the steel. The steam blanket effectively insulates the steel and cooling by contact with water is effectively retarded, if not completely prevented. It is therefore necessary to either penetrate the steam blanket with the water by using high pressure water or to prevent the formation of the steam blanket. We have found that the steam blanket can be successfully prevented from forming by spraying a sufficient quantity of water at a sufficiently high pressure onto the steels as they are being rolled. Pressures of about 25 pounds per square inch gage can be used to achieve results of the method if a sufficient quantity of water in gallons per minute are used. However, an inordinately large quantity of water must be used. We, therefore, prefer to use gage pressures of about 35 pounds per square inch to conserve water. Gage pressures as high as 60 pounds per square inch can be used to achieve the results of the invention but we have found that gage pressures over 60 pounds per square inch do not significantly improve the results of the invention. We, therefore, prefer to use gage pressures of between 35 and 60 pounds per square inch. Of course, the size of the steel being rolled also must be taken into consideration to achieve the results desired. Under normal rolling conditions, small sizes, such as one-half of an inch diameter, do not require the quantity of water at the same gage pressure as do the larger sizes of steel, for example, 1 inch diameter, which larger sizes are produced at higher tonnages per hour. As shown in the nomograph, FIG. 3, a one-half of an inch diameter steel bar or rod being rolled at a rate of 50 tons per hour can be finish rolled to an integrated mean temperature of not more than about 1750° F. by spraying 575 gallons of water per minute at a gage pressure of 35 pounds per square inch onto the surface of the steel. The surface temperature of the steel will be about 1740° F. The quantity of water can be divided into a plurality of streams and can be sprayed at desired locations in the continuous hot-rolling mill. In another example, a steel bar or rod hot-rolled to a finish diameter of 1 inch, rolled at a rate of 150 tons per hour, can be finish rolled to an integrated mean temperature of not more than 1750° F. by spraying 1,730 gallons of water per minute at a gage pressure of 35 pounds per square inch onto the surface of the steel. The surface temperature of the finished steel off-the-mill will be about 1705° F. The quantity of water can be sprayed onto the surface of the steel in several spray units. As noted above, when water comes into contact with steel at the temperatures encountered during hot-rolling, a steam or vapor barrier can form around the steel, thereby providing an efficient insulating blanket to the steel and preventing the cooling of the surface of the steel. It is therefore necessary to prevent the formation of a water bath in the spray units to achieve the results of the invention. The spray units used in the method include means for spraying the water onto the surface of the steel at high pressure, means for axially locating the steel in the spray units and means for collecting and disposing of the sprayed water at a position below the spray units and below the line of passage of the steel through the units to prevent the formation of a water bath in the spray units to thereby prevent the passage of the steel through a water bath.

An apparatus, which can be used in the method of this invention to produce the product of the invention, is described in copending application Ser. No. 416,310 filed Nov. 15, 1973, now U.S. Pat. No. 3,889,507 and assigned to the assignee of this invention, is incorporated herein by reference.

Controlling the temperature of the steel by exposing the surface of the steel to a cooling water spray during hot-rolling in the continuous hot-rolling mill results in an as-rolled product off-the-mill which has an integrated mean temperature of not more than 1750° F. and which can have a surface temperature of about 1700° F. The surface temperature of the steel can approach 1750° F., for example, about 1740° F., but never increases to 1750° F. The as-rolled product off-the-mill has uniform metallurgical properties, substantially uniform microstructure devoid of duplex grain structure at the steel surface and coarse grains in the interior of the steel, and a pearlitic-ferritic fine-grain microstructure, good ductility, good toughness, and a uniform, fine-textured, smooth, relatively thin scale formed on the surface during air-cooling to ambient temperature. Unexpectedly, the method of the invention aids in coiling bars or rods more compactly on the coiling reel than in prior art methods of hot-rolling and coiling. A more compact coil increases the amount of steel which can be formed on a single reel. We have also found that mill speed can be maintained and even increased by controlling the temperature of the steel by spray-cooling during hot-rolling. An increase in production is therefore realized. While we have used water as a coolant, it is possible to use other coolants, such as high pressure air. Of course, the heat transfer characteristics of air are poor and hence air would not be as efficient as water as a coolant. Other commercial type coolants or quenching mediums such as difficult to ignite oils and the like can also be used.

Although we have shown the continuous hot-rolling mill 11 as comprising eight roll stands in the roughing train 12, six roll stands in the intermediate train 21, and four roll stands in the finishing train 28, it must be understood that the mill could include several roughing, intermediate and finishing trains, each train comprising any number of roll stands dependent upon the size of the steel which is to be rolled and the size of the finished product. While a continuous hot-rolling mill can comprise a prescribed number of roll stands in each train, not all the roll stands are used to roll all sizes of steel. In this latter case, the roll stands not in use are referred to as dummy stands. Of course, it is also possible to include a blooming mill or a billet mill prior to the roughing train so that large sized material can be broken down to a size suitable for hot-rolling in the roughing train.

It is common practice to roll billets in the continuous hot rolling mill. However, it will be understood in these specifications and claims that the term "billets" wherever used is to be construed broadly to include blooms and ingots and/or other types of blanks.

In the practice of the method various grades of steel were hot-rolled to a desired finished bar diameter. The results of rolling the various grades of steel are shown in the following Table I: — "Comparison of Properties of Steel Spray-Cooled During Hot Rolling and Non-spray-Cooled During Hot Rolling." The chemical compositions of the steels listed in Table I are listed in Table II: — "Chemical Compositions of Hot-Rolled Steels Shown in Table I."

TABLE I

COMPARISON OF PROPERTIES OF STEEL SPRAY-COOLED DURING HOT ROLLING & NON-SPRAY-COOLED DURING HOT ROLLING
(All Starting stock was 4½ × 4½ inch billets**)

| AISI Grade | Surface Temp. °F. | Yield Strength (psi × $10^3$) | Tensile Strength (psi × $10^3$) | Elongation (%) | Red. in Area (%) | Impact R.T. (Lb-Ft) | Fracture (% Granular) | Scale Thick. (Mils) | Pickling Time (Min.) | BHN |
|---|---|---|---|---|---|---|---|---|---|---|
| 1010 | 1675 | 28.7 | 47.5 | 36.3 | 77.2 | 99.5 | 26.7 | 2.05 | 6 | 78.5 |
| | 1675 | 28.6 | 46.7 | 37.2 | 77.5 | 97.7 | 25.0 | 1.40 | 4 | 77 |
| | *1935 | 31.0 | 52.0 | 29.0 | 69.9 | 88.8 | 28.3 | 3.75 | 12 | 89 |
| 1040 | 1695 | 45.7 | 86.8 | 25.5 | 50.8 | 37.3 | 43.3 | 1.05 | 8 | 161 |
| | *1965 | 42.5 | 84.9 | 23.8 | 45.0 | 22.6 | 65.0 | 4.15 | 15+ | 154.5 |
| 1090 | 1640 | 61.5 | 134.3 | 9.3 | 12.8 | 2.8 | 100.0 | .85 | 8 | 262 |
| | 1700 | 59.4 | 135.5 | 8.5 | 10.4 | 2.0 | 100.0 | 1.25 | 8 | 265.5 |
| | *1930 | 76.8 | 146.6 | 8.5 | 10.2 | 2.8 | 100.0 | 4.15 | 15 | 281 |
| 11L44 | 1695 | 56.2 | 107.5 | 20.8 | 44.0 | 35.7 | 0.0 | 1.05 | 6 | 207 |

TABLE I-continued

COMPARISON OF PROPERTIES OF STEEL SPRAY-COOLED DURING HOT ROLLING & NON-SPRAY-COOLED DURING HOT ROLLING
(All Starting stock was 4½ × 4½ inch billets**)

| AISI Grade | Surface Temp. °F. | Yield Strength (psi × $10^3$) | Tensile Strength (psi × $10^3$) | Elongation (%) | Red. in Area (%) | Impact R.T. (Lb-Ft) | Fracture (% Granular) | Scale Thick. (Mils) | Pickling Time (Min.) | BHN |
|---|---|---|---|---|---|---|---|---|---|---|
| | *1940 | 57.7 | 106.9 | 19.2 | 40.9 | 26.2 | 11.7 | 2.95 | 10 | 216 |
| 1541 | 1680 | 65.0 | 117.4 | 21.5 | 55.6 | 27.0 | 68.3 | 1.40 | 6 | 232 |
| | *1970 | 64.1 | 117.7 | 19.7 | 50.0 | 19.2 | 80.0 | 4.00 | 10 | 241 |
| 3140 | 1635 | 66.4 | 120.4 | 22.5 | 62.1 | 46.3 | 85.0 | .50 | 6 | 229 |
| | *1955 | 66.7 | 121.0 | 17.0 | 42.7 | 14.8 | 100.0 | 6.70 | 15 | 241 |
| 4137 | 1695 | 54.5 | 103.1 | 24.3 | 58.6 | 48.0 | 36.7 | .95 | 6 | 201 |
| | 1695 | 54.9 | 108.4 | 24.3 | 57.6 | 35.7 | 33.3 | 1.00 | 6 | 201 |
| | *1970 | 66.4 | 115.5 | 19.7 | 49.0 | 7.0 | 100.0 | 5.00 | 15 | 209 |
| 4615 | 1655 | 54.2 | 83.5 | 27.2 | 60.7 | 108.3 | 0.0 | .90 | 6 | 163 |
| | *1970 | 57.8 | 81.9 | 25.5 | 57.7 | 43.5 | 63.3 | 4.05 | 16 | 170 |
| 5160 | 1685 | 71.4 | 136.6 | 12.8 | 26.8 | 7.0 | 100.0 | 1.65 | 6 | 269 |
| | *1960 | 74.9 | 139.2 | 12.5 | 26.2 | 5.0 | 100.0 | 6.25 | 15+ | 262 |
| 8115 | 1670 | 47.4 | 76.0 | 33.5 | 68.2 | 120.4 | 0.0 | 1.15 | 6 | 144.5 |
| | *1940 | 41.4 | 76.9 | 32.2 | 65.6 | 118.3 | 5.0 | 2.15 | 10 | 138.5 |
| 8615 | 1655 | 49.1 | 81.7 | 30.5 | 75.7 | 113.7 | 0.0 | .60 | 6 | 163 |
| | *1940 | 45.3 | 79.9 | 27.7 | 58.7 | 50.2 | 50.0 | 4.15 | 15 | 163 |
| 8640 | 1665 | 85.3 | 122.0 | 18.3 | 50.8 | 21.0 | 73.3 | .50 | 6 | 241 |
| | *1950 | 91.1 | 125.3 | 15.7 | 41.8 | 10.3 | 100.0 | 4.20 | 15 | 262 |
| 9260 | 1695 | 71.2 | 137.6 | 16.8 | 30.9 | 6.3 | 100.0 | 2.00 | 2 | 255 |
| | *1970 | 80.9 | 146.7 | 14.8 | 26.5 | 5.3 | 100.0 | 3.70 | 15 | 289 |

**All the billets were rolled to a bar diameter of ¾ of an inch.
*Specimens hot-rolled by a conventional hot-rolling method.

TABLE II

CHEMICAL COMPOSITONS OF HOT ROLLED STEELS SHOWN IN TABLE I

| AISI Grade | C | Mn | P | S | Si | Ni | Cr | Mo | Pb |
|---|---|---|---|---|---|---|---|---|---|
| 1010 | 0.047 | 0.41 | 0.005 | 0.017 | 0.01 | — | — | — | — |
| 1040 | 0.40 | 0.75 | 0.008 | 0.033 | 0.21 | — | — | — | — |
| 1090 | 0.94 | 0.66 | 0.003 | 0.029 | 0.24 | — | — | — | — |
| 11L44 | 0.47 | 1.63 | 0.012 | 0.30 | 0.26 | — | — | — | 0.20 |
| 1541 | 0.43 | 1.74 | 0.013 | 0.020 | 0.22 | — | — | — | — |
| 3140 | 0.44 | 0.82 | 0.007 | 0.016 | 0.26 | 1.18 | 0.57 | — | — |
| 4137 | 0.37 | 0.72 | 0.007 | 0.023 | 0.26 | 0.04 | 0.89 | 0.18 | — |
| 4615 | 0.22 | 0.44 | 0.008 | 0.013 | 0.21 | 1.78 | 0.07 | 0.19 | — |
| 5160 | 0.64 | 0.80 | 0.007 | 0.007 | 0.23 | — | 0.74 | — | — |
| 8115 | 0.18 | 0.88 | 0.007 | 0.007 | 0.31 | 0.29 | 0.34 | 0.09 | — |
| 8615 | 0.22 | 0.83 | 0.010 | 0.010 | 0.24 | 0.49 | 0.49 | 0.13 | — |
| 8640 | 0.43 | 0.80 | 0.007 | 0.007 | 0.27 | 0.50 | 0.49 | 0.14 | — |
| 9260 | 0.59 | 0.89 | 0.005 | 0.005 | 1.96 | — | — | — | — |

The specimens as listed in Table I produced by the conventional method finished at surface temperatures above 1900° F., which is indicative of an integrated mean temperature of more than 1900° F., whereas all the steels which were water sprayed during hot-rolling had a surface temperature of not more than 1700° F. off-the-mill, which is indicative of an integrated mean temperature of not more than 1750° F. The mechanical properties, that is, yield strength and tensile strength and percent elongation of all the specimens were comparable. Generally, the specimens hot-rolled by the method of the invention had better ductility as noted by improved percent reduction in area and also improved toughness at room temperature as noted by the increase in foot pounds recorded in testing standard V-notch Charpy bars according to ASTM E23–72. The scale formed on the surface of products rolled by the method of the invention was uniform, smoother, fine-textured, thinner and more easily removed by pickling in a 12% aqueous solution of $H_2SO_4$ than products hot-rolled conventionally. The shorter time required to remove scale formed on the bars as-rolled and air-cooled hot-rolled by the method of the invention as compared to the time required to remove scale from the bars hot-rolled by a conventional method should be noted.

We have described the method of the invention and have shown spray units in the continuous hot-rolling mill after the first two roll stands and before the last two stands in the intermediate train and spray units in tandem before the first roll stand in the finishing train; however, the benefits of the method of the invention can be realized by using any one of several possible combinations of spray units interspersed between the roll stands in the intermediate train and in the roll stands of the finishing train. Dependent upon the size of the steel which is being rolled any number of spray units of the same size can be used. All that is necessary to produce a steel product off-the-mill having an integrated mean temperature of not more than 1750° F. is that the steel be passed through at least one, and preferably a plurality of spray units prior to being rolled to finish size in the last stand of the finishing train. Spray-cooling should be done as early as possible in the intermediate or finishing train so that the temperature of the steel can stabilize prior to rolling to finish size. While spray-cooling is beneficial, care must be taken to prevent cooling the steel to temperatures incompatible with good hot-rolling techniques.

It must also be understood that sections such as rounds, squares, hexagonals, octagonals, and the like can be produced by the method of the invention.

Figure 4:
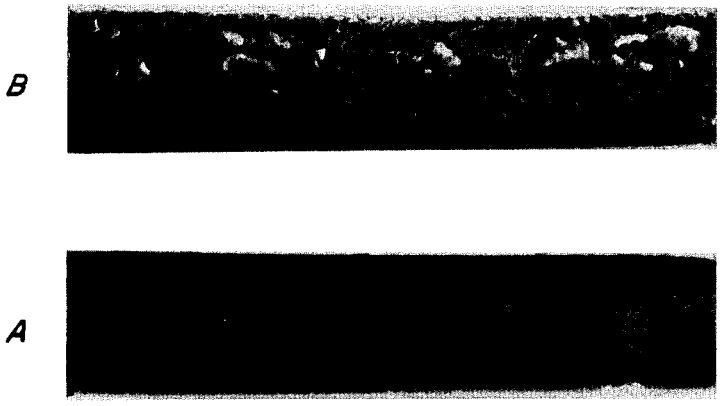
FIG. 4 is a photograph at full scale comparing scale formed on the surface of an as-rolled air-colled product, i.e., AISI 1040 grade steel in the form of three-fourths of an inch diameter rod, produced by the method of the invention and an as-rolled air-cooled product, also made of 1040 grade steel and in the form of three-fourths of an inch diameter rod, produced by a conventional hot-rolling method.

As noted previously, the scale formed on the surface of the steel product air-cooled to ambient temperature after hot rolling by the method of the invention is uniform, fine-textured, smooth and relatively thin, being generally between 1.0 to 2.0 mils in thickness. The scale formed on the surface of the products air-cooled after hot-rolling by conventional or prior art methods, on the other hand, is non-uniform, coarse, uneven and is generally about 4 mils in thickness, but may be as little as 3 mils and as much as 6.5 mils in thickness. A comparison of the scale formed on the surface of air-cooled bars after hot-rolling by the method of the invention as described above and the scale formed on the surface of bars air-cooled after hot rolling by conventional or prior art methods is shown in FIG. 4. The specimen identified as "A" is a portion of a three-fourths of an inch diameter coiled bar as-rolled from a 4½ inch by 4½ inch by 40 foot long billet. The grade is AISI 1040 steel. The bar was hot-rolled by the method of the invention as described above. The specimen identified as "B" is a portion of a three-fourths of an inch diameter coiled bar as-rolled from a 4½ inch by 4½ inch by 40 foot long billet. The grade is AISI 1040 steel. The bar was hot rolled by a conventional method, that is, not cooled prior to rolling to finish size. Note that the scale on the surface of the bar identified as specimen A is uniform, smooth, fine-textured and relatively thin, being about 1.5 mils in thickness, whereas the scale on the surface of the bar identified as specimen B is non-uniform, coarse, rough and relatively thick, being about 5.5 mils in thickness.

Figure 5:
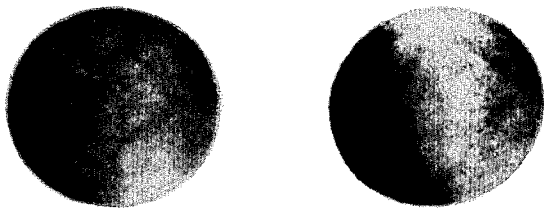
FIG. 5 is an enlarged photograph comparing the macrostructure of an as-rolled air-cooled coiled bar, three-fourths of an inch in diameter, of AISI 1040 grade steel produced by a conventional hot-rolling method.

The steel product produced by the method of the invention has a uniform as-rolled macrostructure whereas the steel product produced by a conventional hot-rolling method has a duplex grain structure at two areas 180° apart near the surface of the product. Specimens cut from an AISI 1040 grade steel bar, three-fourths of an inch diameter, produced by the method of the invention and an AISI 1040 grade steel bar, three-fourths of an inch diameter, produced by a prior art method showing a etched transverse plane of the bars are shown for comparison purposes in FIG. 5. FIG. 5 is a photograph at two magnifications of the etched transverse plane of each of the two bars. The bar produced by the method of the invention, that is, spray-cooled during hot-rolling, is identified as specimen C and the bar produced by conventional hot-rolling, that is, not spray-cooled during hot-rolling, is identified as specimen D. Specimen C has a uniform macrostructure whereas specimen D has a non-uniform macrostructure. Duplex grain structure can be seen near the surface of the specimen 180° apart.

Figure 6:
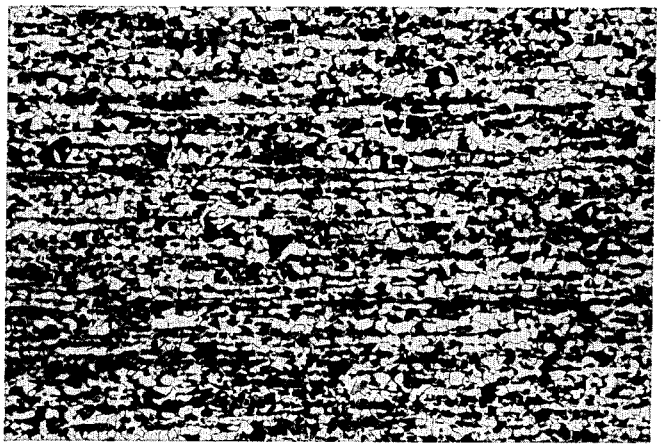
FIG. 6 is a photomicrograph taken at 100 magnifications of the microstructure in a longitudinal plane near the center of a specimen cut from an as-rolled air-cooled bar, three-fourths of an inch in diamter, of AISI 1040 grade steel produced by the method of the invention.
Figure 7:
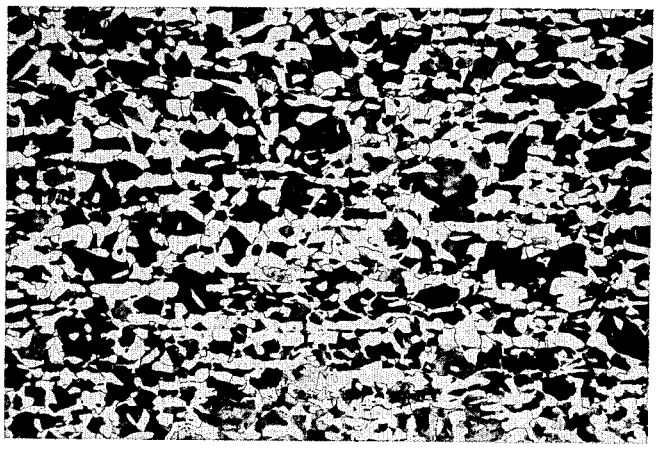
FIG. 7 is a reproduction of a photomicrograph taken at 100 magnifications in a longitudinal plane near the center of a specimen cut from an as-rolled air-cooled carbon steel bar, AISI 1040 grade, three-fourths of an inch in diamter, hot-rolled by the conventional hot-rolling method.

The as-rolled air-cooled microstructure developed in AISI 1040 grade steel which is water-cooled while being continuously hot-rolled is shown in FIG. 6. The microstructure is taken on a longitudinal plane of a specimen cut from the as-rolled air-cooled coiled bar which is three-fourths of an inch in diameter. The microstructure consists of finely divided uniformly distributed pearlite in a fine-grained ferritic matrix. The microstructure shows uniform "banding" of the pearlite and ferrite. In comparison, the microstructure in a longitudinal plane of a specimen cut from an as-rolled air-cooled coiled bar which is three-fourths of an inch in diameter, AISI 1040 grade steel hot-rolled by a conventional method in which the steel was not spray-cooled during hot-rolling, consists of coarse grained pearlite in a coarse grained ferritic matrix. There does not appear to be any evidence of banding. The microstructure is shown at 100 magnifications in FIG. 7. The as-rolled air-cooled microstructure shown in FIG. 6 is representative of the microstructures also found in steel grades 1010, 1090, 11L44, 1524, 1541 and 8115 which are spray-cooled during hot-rolling.

Figure 8:
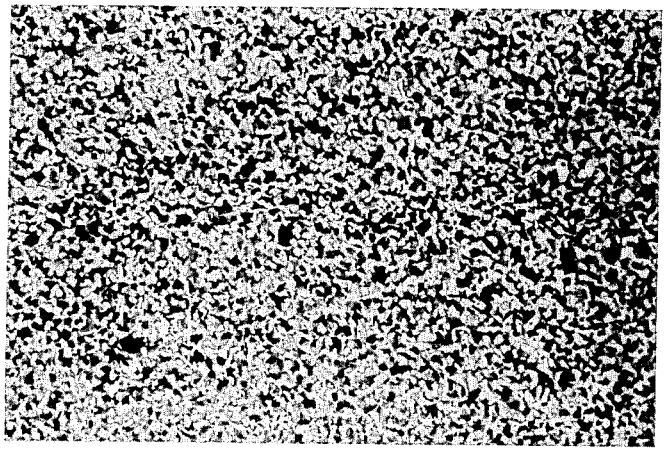
FIG. 8 is a photomicrograph taken at 100 magnifications of the microstructure in a transverse plane at the center of a specimen cut from an as-rolled air-colled coiled bar, three-fourths of an inch in diameter, AISI 1040 grade steel hot rolled by the method of the invention.

FIG. 8 is a photomicrograph taken at 100 magnifications of the microstructure at the bar center on a transverse plane of a coiled bar three-fourths of an inch in diameter, AISI 1040 grade steel which was spray-cooled with water while being continuously hot-rolled. The microstructure is representative of the microstructure found in the bar. The microstructure consists of finely divided uniformly distributed pearlite in a fine-grained ferritic matrix.

Figure 9:
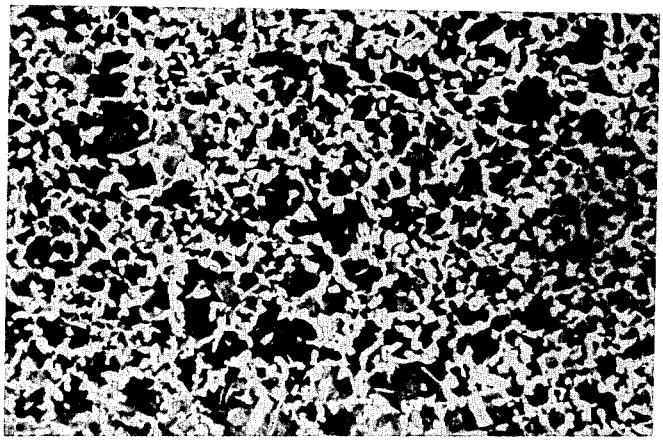
FIG. 9 is a photomicrograph taken at 100 magnifications of the microstructure in a transverse plane near the center of a specimen cut from an as-rolled air-cooled coiled bar three-fourths of an inch in diameter, AISI 1040 grade steel hot-rolled by a conventional hot-rolling method.
Figure 10:
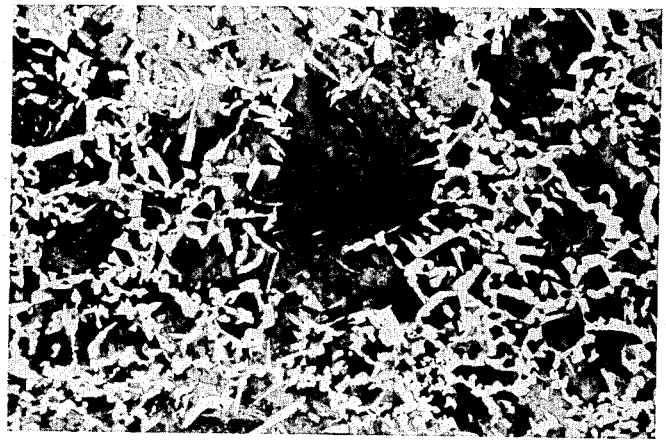
FIG. 10 is a photomicrograph taken at 100 magnifications of the microstructure in a transverse plane near the surface of the same coiled bar as shown in FIG. 9.

FIGS. 9 and 10 are photomicrographs taken at 100 magnifications of the microstructure at the bar center and bar edge respectively on a transverse plane of a specimen cut from a coiled bar three-fourths of an inch in diameter of AISI 1040 grade steel which was continuously hot-rolled in a conventional hot-rolling method, that is, the surface was not water-cooled during hot-rolling. The microstructure as shown in FIG. 9 consists of relatively coarse non-uniformly distributed pearlite in a ferritic matrix. The microstructure shown in FIG. 10 shows duplex grain structure of pearlite in a ferritic matrix. It is obvious that the microstructure formed in the coiled bar which is water-cooled during hot-rolling, shown in FIG. 8, is desirable whereas the microstructure formed in the coiled bar which was not spray-cooled during continuous hot-rolling as shown in FIGS. 9 and 10 is undesirable.

Figure 11:
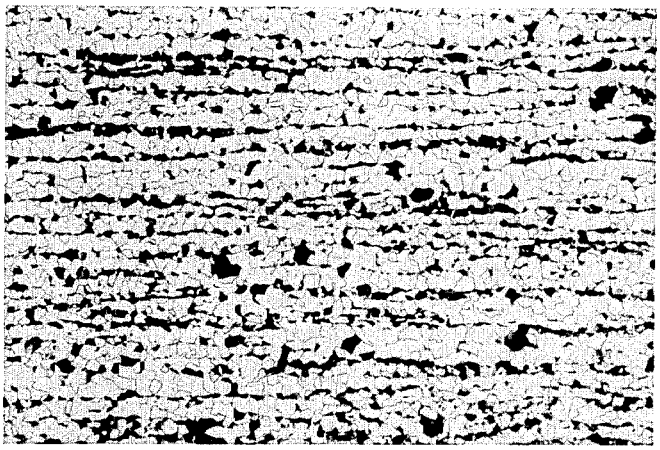
FIG. 11 is a photomicrograph taken at 100 magnifications of the microstructure in a longitudinal plane near the center of an as-rolled air-cooled coiled bar, three-fourths of an inch diameter AISI 8615 grade steel produced by the method of the invention.
Figure 12:
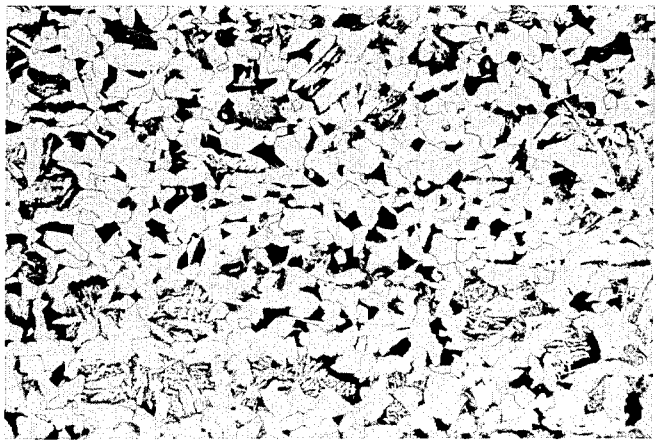
FIG. 12 is a reproduction of a photomicrograph taken at 100 magnifications at the center of a longitudinal plane of an alloy steel bar, AISI 8615 grade, three-fourths of an inch in diameter, hot-rolled by the conventional hot-rolling method.

FIGS. 11 and 12 are photomicrographs taken at 100 magnifications at the bar center on longitudinal planes of the microstructure of a specimen cut from an as-rolled air-cooled coiled bar three-fourths of an inch in diameter of AISI 8615 grade steel water-cooled during continuous hot-rolling, and a specimen cut from an as-rolled air-cooled coiled bar three-fourths of an inch in diameter of AISI 8615 grade steel which was hot-rolled in a conventional manner, respectively. The microstructure shown in FIG. 11 is representative of the microstructure developed in AISI steel grades 3140, 4137, 4615, 8615 and 8640 which are spray-cooled during hot-rolling. The microstructure consists of finely divided uniformly distributed pearlite in a fine-grained ferritic matrix. There is some "banding" as shown in the longitudinal plane but the "banding" is not detrimental to the steel. The microstructure as shown in FIG. 12 is coarse pearlite and acicular bainite in a coarse ferritic matrix. This microstructure is undesirable.

Figure 13:
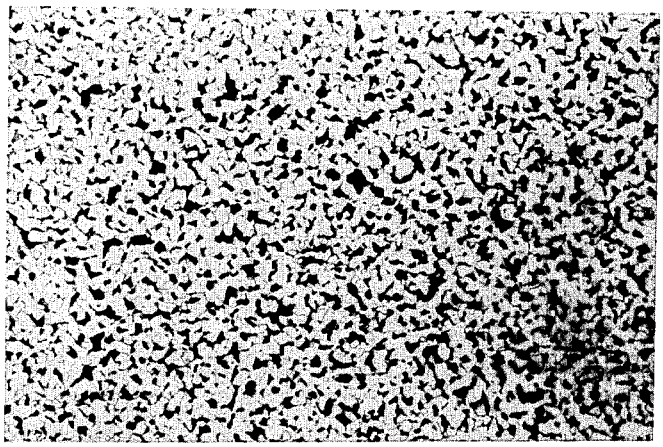
FIG. 13 is a photomicrograph taken at 100 magnifications of the microstructure in a transverse plane near the center of a specimen cut from an as-rolled air-cooled coiled bar, three-fourths of an inch in diameter, AISI 8615 grade steel hot-rolled by the method of the invention.

FIG. 13 is a photomicrograph taken at 100 magnifications of the microstructure at the center on a transverse plane of a specimen cut from a coiled bar, three-fourths of an inch in diameter, AISI 8615 grade steel which was spray-cooled during hot-rolling. The microstructure consists of finely divided uniformly distributed pearlite in a fine-grained ferritic matrix and is representative of the microstructure seen in cross-section.

Figure 14:
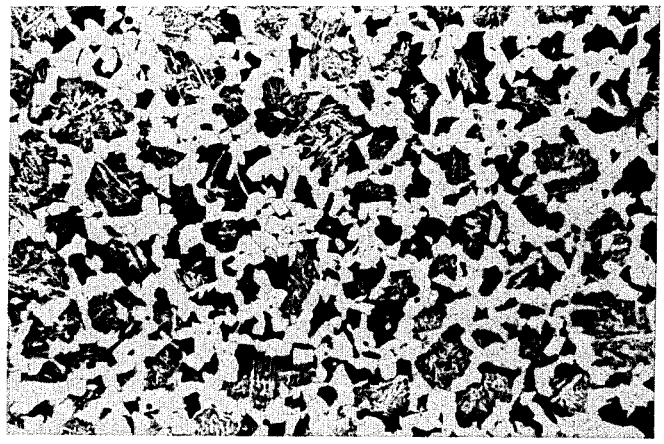
FIGS. 14 and 15 are photomicrographs taken at 100 magnifications of the microstructure in a transverse plane formed at the center and near the surface, respectively, of a specimen cut from an as-rolled air-cooled coiled bar, three-fourths of an inch in diameter, AISI 8615 grade steel continuously hot-rolled by a conventional hot-rolling method.
Figure 15:
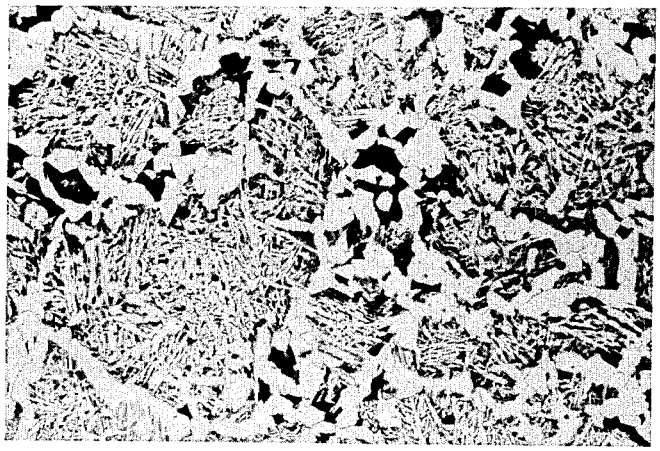

FIGS. 14 and 15 are photomicrographs taken at 100 magnifications of the microstructure at the center and at the edge, respectively, of a three-fourths of an inch diameter coiled bar of AISI 8615 grade steel hot-rolled by a conventional method. The microstructure is relatively coarse non-uniform acicular bainite and small areas of pearlite in a ferritic matrix in the center of the bar as seen in FIG. 14, and large areas of acicular bainite and small areas of pearlite in a ferritic matrix near the edge or surface of the bar in FIG. 15.

From a study of the above reproductions of the photomicrographs it can be seen that the microstructures of the coiled bars produced by spray-cooling the steel during hot-rolling consist of finely divided pearlite uniformly distributed in a fine-grained ferritic matrix in both longitudinal and transverse cross-section and are to be preferred over the coarse non-uniform microstructures of the coiled bars produced by the conventional hot-rolling method.

The study directed to the effect of pickling as-rolled rods produced by the method of the invention in a pickling solution was conducted on specimens which were two inches in length, cut from the as-rolled bars. The specimens were placed in a sulfuric acid pickling solution containing 12% $H_2SO_4$ by volume, the remainder water, for a period of time.

We have found that the type of scale which forms on the surface of an as-rolled product during air-cooling to ambient temperature is directly related to the integrated mean temperature of the hot-rolled product off-the-mill. At an integrated mean temperature of not more than 1750° F. a uniform, fine-textured, smooth and relatively thin scale forms during air cooling to ambient temperature on the surface of the steel. As the integrated mean temperature and the surface temperature of the as-rolled product off-the-mill is lowered, the thickness of the scale decreases and the uniformity improves. As the integrated mean temperature increases above 1750° F. the scale becomes coarser, uneven and thicker. At the usual surface temperatures of 1850° F. to 2100° F. off-the-mill, the scale which forms on the surface of the as-rolled product is non-uniform, coarse, uneven and relatively thick. It has been generally believed that spray-cooling rolled steel would create a problem because of increased stiffness in the as-rolled steel product, particularly in the case of bars, because the bars would not be coilable. Contrary to popular belief, we have found that by controlling where the steel is spray-cooled during its passage through the continuous hot rolling mill and prior to finish rolling to size, the steel can be rolled to finish size with no difficulty on the finishing train. The increased stiffness which occurs in the steel has proven to be an advantage rather than a disadvantage in the case of coiled bars and rods because when the bars and rods are coiled the increased stiffness makes it possible to make a more dense coil. It is, therefore, possible to increase the amount of steel bars which can be coiled on a given reel or to coil the same amount of steel bars as conventionally coiled but in a dimensionally smaller coil.

In a specific example of the invention, 2400 pounds of AISI 1040 grade carbon steel billets, 4½ inches by 4½ inches by 40 feet long, were heated to a hot rolling temperature of 2100° F. in a dual-zone oil fired furnace. The steel was rolled at a rate of 112 tons per hour to produce a three-fourths of an inch diameter bar which was coiled. The steel had a chemical composition of 0.40% carbon, 0.67% manganese, 0.008% phosphorus, 0.33% sulfur and 0.21% silicon. The billets were rolled in an 11-inch continuous hot-rolling mill having eight roll stands in the roughing train (two rolling stands were dummy stands), six rolling stands in the intermediate train (two rolling stands were dummy stands), and four rolling stands in the finishing mill as shown in FIG. 1. Several billets were rolled in the following sequence which shows the train, the rolling stand number, the cross-sectional area of the steel formed in the stand, the speed of the billets and temperature of the billets at several points as they pass through the mill:

| Stand No. | Reduction in Cross-Sectional Area (Inches)² | Speed of Billets (Ft/Min) | Temp. of Surface (°F.) |
|---|---|---|---|
| Roughing Train | | | |
| 13–20 | 19.97 to 3.1 | 55 to 356 | 2100° |
| | | Crop | |
| Intermediate Train | | | |
| 22 | 2.07 | 535 | |
| 23 | 1.51 | 732 | |
| 24 | Dummy | | |
| | | | 1970° |
| 25 | Dummy | | |
| | | Spray Units 50 and 51 | |
| 26 | 1.16 | 953 | |
| | | | 1715° |
| 27 | 0.918 | 1205 | |
| | | Spray Units 52 and 53 | |
| Finishing Train | | | |
| 29 | 0.734 | 1500 | |
| 30 | 0.612 | 1805 | |
| 31 | 0.505 | 2190 | |
| 32 | 0.442 | 2500 | 1695° |
| | | Flying Shear 49 | |

The integrated mean temperature of the as-rolled steel off-the-mill was 1720° F. Several other billets were hot-rolled in the same rolling sequence but were not spray-cooled at a controlled rate during hot-rolling, that is, the billets were hot-rolled in a conventional hot-rolling sequence.

The three-fourths of an inch diameter bars produced by the above described hot-rolling methods were coiled on conventional reeling equipment and while in coil form were air-cooled to ambient temperature.

A comparison of the scale formed on the coil bars during air-cooling showed that the scale on the bars hot-rolled by the method of the invention was uniform, fine-textured, smooth and about 1.0 mil in thickness whereas the scale on the bars hot-rolled by the conventional method was non-uniform, coarse, uneven and about 4.0 mils in thickness.

Specimens cut from bars rolled by each of the above methods were pickled to remove the scale from the surface. The specimens were placed in a 12% aqueous solution of $H_2SO_4$. The specimens cut from bars which were hot-rolled by the method of the invention had all the scale removed from the surfaces in about 8 minutes whereas the specimens from bars which were hot-rolled by the conventional method still retained scale on the surfaces after 15 minutes in the pickling solution.

The microstructures of the bars were studied and compared at a magnification of 100 diameters. The microstructure of the bars which were hot-rolled by the method of the invention consisted of pearlite uniformly distributed in a ferritic matrix and had a uniform grain size, whereas the bars hot-rolled by a conventional method had non-uniform coarse pearlite in a ferritic matrix at the center and a duplex large grain structure and pearlite in a ferritic matrix.

The macrostructure of the bars showed a uniform grain structure in the bars hot-rolled by the method of the invention and non-uniform grain structure of coarse grains in the exterior or edge and finer grains near the center of the bars hot-rolled by the conventional method.

Excellent uniform elongation in the grain structure was found in a longitudinal direction in bars rolled by the method of the invention whereas poor, non-uniform coarse grain structure was found in the bars rolled by the conventional method.

The mechanical properties of the bars were determined by testing standard 0.505-inch round tensile specimens according to ASTM E23–72. the mechanical properties of the bars were similar but the ductility as measured by the percent reduction-in-area of the test specimens showed the bars rolled by the method of the invention to be 50.18% whereas the bars rolled by the conventional method was 45.0%. The toughness of the bars rolled by the method of the invention, as determined by testing standard V-notch Charpy bars according to ASTM E23–72 showed the bars rolled by the method of the invention to have a value of 37.3 foot-pounds at ambient temperatures.

In another specific example of the invention, 2400 pounds of AISI 4137 grade steel billets 4½ inches by 4½ inches by 40 foot long were processed at a rate of 120 tons/hour in the same manner as that described in the first specific example. The integrated mean temperature of the steel was 1695° F. The billets had the following chemical composition: 0.37% carbon, 0.72% manganese, 0.00770% phosphorus, 0.023% sulfur, 0.26% silicon, 0.89% chromium and 0.18% molybdenum. The results of the test follow:

| Controlled Cooling During Hot Rolling | Non-Cooling During Hot Rolling |
|---|---|
| Scale | |
| Uniform, fine, smooth having a thickness of 0.95 mils | Non-uniform, coarse, uneven, thickness of 5.0 mils |
| Scale Removal | |
| 6 minutes | 15 minutes |
| Microstructure | |
| Uniform, pearlite in a ferritic matrix | Non-uniform, acicular bainite |
| Macrostructure | |
| Uniform grain size | Non-uniform grain coarse at the surface and finer grain size in the interior |
| Some banding | No banding |
| Ductility | |
| 58.16% Red. in area | 49.0% Red. in area |
| Toughness | |
| 48.0 foot-pounds at ambient temperature | 7.0 foot-pounds at ambient temperature |

In a third specific example of the invention 2400 pounds of AISI 8615 grade alloy steel was processed at a rate of 120 tons/hour the same as described in the first specific example. The integrated mean temperature of the steel was 1655° F. The results of the testing follow:

| Controlled Cooling During Rolling | Non-Cooling During Rolling |
|---|---|
| Scale | |
| Uniform, fine, even thickness — 0.5 mils | Non-uniform, coarse, uneven thickness — 4.20 mils |
| Scale Removal | |
| 6 minutes | 15 minutes |
| Microstructure | |
| Uniform pearlite in a ferritic matrix | Non-uniform coarse acicular bainite and some pearlite in a ferritic matrix |
| Macrostructure | |
| Uniform grain size and some banding | Non-uniform grain size with no banding |
| Ductility | |
| 50.8% Red. in area | 41.8% Red. in area |
| Toughness | |
| 21.0 foot-pounds at ambient temperature | 10.13 foot-pounds at ambient temperature |

In this specification and claims a carbon steel grade can have a chemical composition within the following ranges:

| | |
|---|---|
| Carbon | .06 to 1.20% |
| Manganese | 0.30 to 1.60% |
| Phosphorus | 0.05% max. |
| Sulfur | 0.05% max. |

and can include any carbon steel grade, for example, C1006, C1040, C1060, C1090, B1006, D1059 and the like.

Resulfurized carbon steel grades, for example, C1006, C1126, B1111, B1113 and the like, can also be treated by the method of the invention.

Alloy steel grades, for example, AISI grades within the series 1300, 2300, 3100, 4000, 4100, 4300, 4600, 4800, 5000, 5100, 6100, 8600, 8700, 9200, 9400, 9700 and the like, can also be rolled by the method of the invention.

In this specification and claims all percentages referred to are on a weight basis unless otherwise identified.

We claim:

1. A method for producing an as-rolled steel product taken from the group consisting of a bar and rod from a steel billet in a continuous hot rolling mill having a plurality of roll stands in a roughing train, an intermediate train and a finishing train wherein said steel billet is progressively reduced in cross-sectional area, comprising:
   a. heating said steel billet to a temperature of about 1950° F. to about 2100° F.,
   b. passing said heated steel billet through said roughing train to effect a first reduction in cross-sectional area,
   c. passing said heated steel billet through said intermediate train,
   d. controlling the temperature of said heated steel billet in step (c) by spraying said steel billet with a liquid coolant in at least one spray cooling unit between selected roll stands of said intermediate train, and
   e. passing said steel billet through said finishing train to produce an as-rolled steel product having an integrated mean temperature of not more than about 1750° F.

2. The method of claim 1 wherein said steel billet is spray cooled a second time after passing through said intermediate train but prior to entering the finishing train.

3. The method of claim 1 wherein said steel billet is spray cooled a second time in said finishing train.

4. The method of claim 1 wherein the spraying of step (d) is initiated just subsequent to passage of the leading end of the billet through the spray zone so as to avoid hardening said end to avoid damage to rolls located beyond the location of spraying.

5. The method of claim 1 wherein the liquid coolant sprayed on said billet in step (d) is a quantity determined in accordance with the function:

$$T_m = f\,\frac{q\sqrt{p}}{W}$$

wherein $q$ is quantity of water sprayed onto the surface of the steel in gallons per minute, $p$ is gage pressure of water in pounds per square inch, $w$ is rate of rolling steel in tons per hour.

6. A method for producing an as-rolled steel product taken from the group consisting of a bar and rod from a steel billet in a plurality of roll stands of a continuous hot rolling mill, comprising:

a. heating said billet to within a temperature range of about 1950° F. to 2100° F., b. passing said heated billet through said mill to progressively reduce its cross-sectional area, and c. controlling the temperature of said heated billet during step (b) by spraying said billet with a liquid coolant between selected roll stands whereby the integrated mean temperature of the as-rolled steel product is not more than about 1750° F.

7. The method of claim 6 wherein the liquid coolant spraying of step (c) results in an as-rolled air-cooled steel product having a uniform equiaxed microstructure of finely divided pearlite in a fine grained ferritic matrix, uniform macrostructure, and a uniform thin scale formed on the surface of said finished product.

8. A product produced by the method of claim 7 wherein the steel product is comprised of carbon steel containing 0.10% to 0.95% carbon.

9. The product as produced by the method of claim 7 wherein the steel product is comprised of an alloy steel.

10. The product produced by the method of claim 9 wherein the thickness of the scale is not more than about 2 mils.

11. The product produced by the method of claim 10 wherein the thickness of the scale is not more than about 2 mils.

* * * * *

UNITED STATES PATENT OFFICE

CERTIFICATE OF CORRECTION

Patent No. 3,981,752 Dated September 21, 1976

Inventor(s) Helmut Kranenberg et al.

It is certified that error appears in the above-identified patent and that said Letters Patent are hereby corrected as shown below:

Col. 1, line 6, "Ser. No. 414,309" should read --416,309--.

Col. 3, line 27, "contactt" should read --contact--.

Col. 3, line 42, "to" , first occurrence, should read -- is --.

Col. 5, line 35, "air-colled" should read --air-cooled--.

Col. 5, line 61, "air-colled" should read --air-cooled--.

Col. 10, line 12, "crosssection" should read --cross-section--

Col. 15, line 41, "a" should read --an--.

Col. 19, line 8, 'the" should be capitalized --The-- entence).

Col. 22, claim 10, the word "as" should be inserted after "product"

Col. 22, claim 11, the word "as" should be inserted before "produced".

Col. 22, claim 10, should read --of claim 8-- (not of claim 7)

Col. 22, claim 11, "of claim 10" should read --of claim 9--.

Signed and Sealed this

Eighth Day of February 1977

[SEAL]

*Attest:*

RUTH C. MASON
*Attesting Officer*

C. MARSHALL DANN
*Commissioner of Patents and Trademarks*